US007990067B2

(12) United States Patent
Naoi et al.

(10) Patent No.: US 7,990,067 B2
(45) Date of Patent: Aug. 2, 2011

(54) PLASMA DISPLAY PANEL

(75) Inventors: Taro Naoi, Yamanashi (JP); Hai Lin, Yamanashi (JP)

(73) Assignee: Panasonic Corporation, Kadoma (JP)

( * ) Notice: Subject to any disclaimer, the term of this patent is extended or adjusted under 35 U.S.C. 154(b) by 242 days.

(21) Appl. No.: 11/907,671

(22) Filed: Oct. 16, 2007

(65) Prior Publication Data

US 2008/0157671 A1 Jul. 3, 2008

(30) Foreign Application Priority Data

Dec. 27, 2006 (JP) ..... 2006-352247

(51) Int. Cl.
*H01J 17/49* (2006.01)

(52) U.S. Cl. ..... 313/586

(58) Field of Classification Search ..... 313/582–587, 313/598; 345/41; 315/169.4
See application file for complete search history.

(56) References Cited

U.S. PATENT DOCUMENTS

| | | | | |
|---|---|---|---|---|
| 6,242,864 | B1 * | 6/2001 | Nakahara et al. | 315/169.3 |
| 2003/0030377 | A1 * | 2/2003 | Hirano et al. | 313/587 |
| 2005/0206318 | A1 * | 9/2005 | Hirota et al. | 313/585 |
| 2005/0264211 | A1 * | 12/2005 | Kim | 313/587 |
| 2007/0096653 | A1 * | 5/2007 | Jeong et al. | 313/586 |

FOREIGN PATENT DOCUMENTS

| | | | |
|---|---|---|---|
| JP | 2006-059779 | | 3/2006 |
| JP | 2006-059780 | | 3/2006 |
| KR | 1020050066570 | * | 6/2005 |

* cited by examiner

*Primary Examiner* — Joseph L Williams
*Assistant Examiner* — Brenitra M Lee
(74) *Attorney, Agent, or Firm* — Arent Fox LLP

(57) ABSTRACT

Row electrode pairs and column electrodes are provided between the front glass substrate and the back glass substrate. Magnesium oxide single-crystal particles, which are doped with aluminum and have characteristics of causing cathode luminescence having a peak within a wavelength range of 200 nm to 300 nm upon excitation by application of electron beams, are disposed in a position facing the discharge cells, and form part of a protective layer for a dielectric layer overlying the row electrodes and/or phosphor layers.

4 Claims, 7 Drawing Sheets

FIRST EMBODIMENT

SECTION V-V

SINGLE-CRYSTAL MgO OF CUBIC OR
RECTANGULAR PARALLELEPIPED STRUCTURE

DISCHARGE DELAY a:MgO SINGLE CRYSTAL PARTICLES DOPED WITH 1100 PPM Al
b:MgO SINGLE CRYSTAL PARTICLES DOPED WITH 14 PPM Al
c:VAPOR-DEPOSITED THIN-FILM MgO LAYER ALONE

CL INTENSITY d:MgO SINGLE CRYSTAL DOPED WITH 1100 PPM Al AND PRODUCED BY LIQUID PHASE METHOD e:MgO SINGLE CRYSTAL DOPED WITH 14 PPM Al AND PRODUCED BY LIQUID PHASE METHOD f:MgO SINGLE CRYSTAL PRODUCED BY GAS PHASE METHOD

SECOND EMBODIMENT

THIRD EMBODIMENT

FOURTH EMBODIMENT

FIFTH EMBODIMENT

PLASMA DISPLAY PANEL

BACKGROUND OF THE INVENTION

1. Field of the Invention

This invention relates to structure of plasma display panels.

The present application claims priority from Japanese Application No. 2006-352247, the disclosure of which is incorporated herein by reference.

2. Description of the Related Art

One of conventional various PDPs (Plasma Display Panel hereinafter referred to as "PDP"), which is disclosed, for example, in Japan Unexamined Patent Publication No. 2006-59779, comprises a magnesium oxide layer that face each of the discharge cells defined in the discharge space between the front glass substrate and the back glass substrate and includes a magnesium oxide crystal having characteristics of causing cathode luminescence having a peak within a wavelength range of 200 nm to 300 nm upon excitation by electron beams. Another PDP has a dielectric layer deposited on the inner face of the front glass substrate so as to overlie discharge electrodes. The dielectric layer is covered with a protective layer that comprises lamination of a thin-film magnesium oxide layer and a crystalline magnesium oxide layer. The thin-film magnesium oxide layer is deposited by vapor deposition or by sputtering. The crystalline magnesium oxide layer includes a magnesium oxide crystal that has characteristics of causing cathode luminescence having a peak within a wavelength range of 200 nm to 300 nm upon excitation by electron beams. Such a PDP is disclosed, for example, in Japan Unexamined Patent Publication No. 2006-59780.

These conventional PDPs have discharge characteristics such as discharge probability and discharge delay that are improved by magnesium oxide crystal placed facing the discharge cells and having characteristics of causing cathode luminescence having a peak within a wavelength range of 200 nm to 300 nm upon excitation by electron beams, thus having a technical feature of the capability of offering satisfactory discharge characteristics.

In recent years, displays capable of producing a high definition screen, such as a full HD screen, have come on the market. For realizing a high definition screen such as a full HD screen, the PDP is required to be improved in discharge delay for a further improvement of the discharge characteristics.

SUMMARY OF THE INVENTION

It is an object of the present invention to respond the need for an increase in the performance of PDPs as described above.

To attain this object, the present invention provides a plasma display panel comprising a pair of opposing substrates placed across a discharge space, discharge electrodes disposed between the pair of opposing substrates, a dielectric layer covering the discharge electrodes, and phosphor layers, in which the discharge space is divided to form a plurality of unit light emission areas arranged in matrix form, and magnesium oxide crystal particles, which are doped with a required concentration of aluminum and have characteristics of causing cathode luminescence having a peak within a wavelength range of 200 nm to 300 nm upon excitation by application of electron beams, are disposed in a position facing each unit light emission area between the pair of opposing substrates.

In a best mode for carrying out the PDP of the present invention, row electrode pairs and column electrodes are provided between the front glass substrate and the back glass substrate. The row electrode pairs extend in the row direction and the column electrode extend in the column direction to form discharge cells (unit light emission areas) in the discharge space at intersections with the row electrode pairs. Magnesium oxide crystal particles, which are doped with aluminum and have characteristics of causing cathode luminescence having a peak within a wavelength range of 200 nm to 300 nm upon excitation by application of electron beams, are disposed in a position facing the discharge cells, and form part of a protective layer for a dielectric layer overlying the row electrodes and/or phosphor layers.

The PDP in this mode is capable of improving the discharge delay in the discharge operation, because the magnesium oxide crystal particles disposed in a position facing the discharge cells have characteristics of causing cathode luminescence having a peak in a wavelength range of 200 nm to 300 nm upon excitation by electron beams. Also, the magnesium oxide crystal particles are doped with a required concentration of aluminum, thus making it possible to more effectively provide the improvement of the discharge delay. In consequence, an increase in performance of PDPs for forming a high definition screen such as a full HD screen is achieved.

In the PDP of the mode, the concentration of aluminum doped in the magnesium oxide crystal particles produced by a liquid phase method preferably ranges from 10 ppm to 10,000 ppm. The intensity of cathode luminescence is increased when the aluminum concentration is in this range, leading to further improvement in discharge delay.

In addition, in the PDP of the mode, the magnesium oxide crystal particles preferably include a magnesium oxide single crystal having an average particle diameter between 10 nm and 10 μm and having a rectangular parallelepiped structure. Further, the magnesium oxide crystal particles preferably have characteristics of causing cathode luminescence having a peak within a wavelength range of 230 nm to 250 nm, thus further improving the required discharge delay.

In the PDP of the mode, the magnesium oxide crystal particles are exposed to the unit light emission areas. This is achieved by various forms. For example, the magnesium oxide crystal particles may form a protective layer disposed on the dielectric layer and overlying the dielectric layer. Alternatively, the magnesium oxide crystal particles may be disposed on a thin-film magnesium oxide layer which is formed on the dielectric layer by vapor deposition or sputtering, and the magnesium oxide crystal particles together with the thin-film magnesium oxide layer may form the protective layer for the dielectric layer. The magnesium oxide crystal particles may be locally disposed on a portion of the thin-film magnesium oxide layer facing a portion of the discharge electrodes across which a discharge is initiated, in each unit light emission area by use of a patterning technique. The magnesium oxide crystal particles may be included in the phosphor layers and exposed to the unit light emission areas.

These and other objects and features of the present invention will become more apparent from the following detailed description with reference to the accompanying drawings.

DETAILED DESCRIPTION OF THE PREFERRED EMBODIMENTS

First Embodiment

Figure 1:
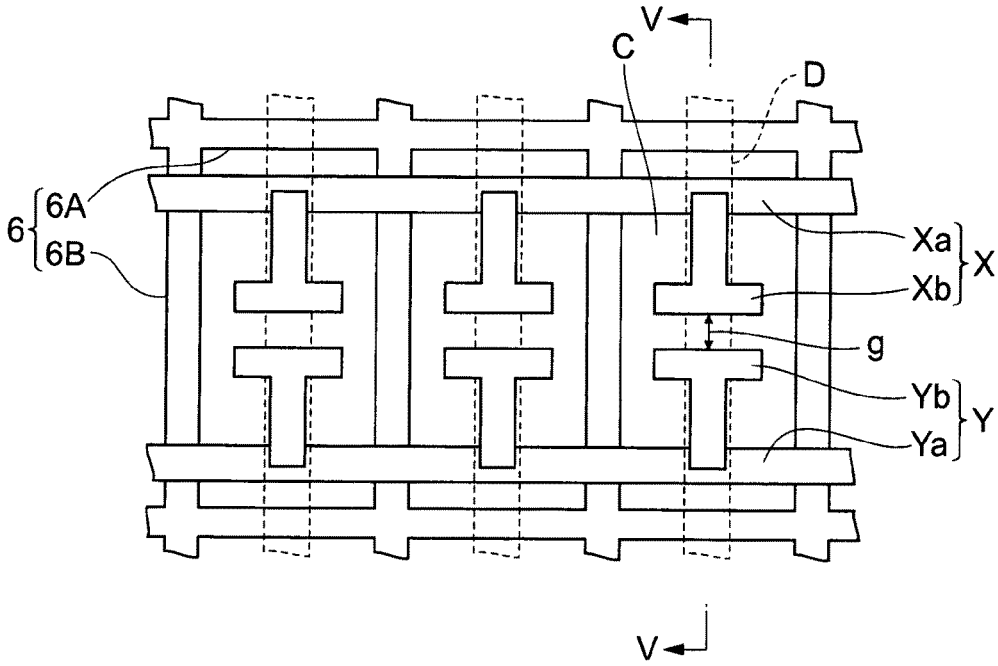
FIG. 1 is a front view illustrating a first embodiment according to the present invention.
Figure 2:
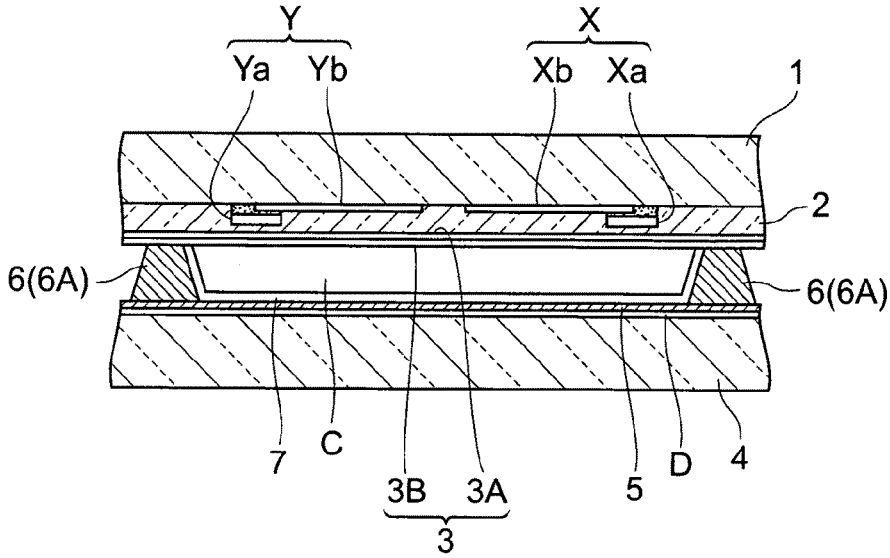
FIG. 2 is a sectional view taken along the V-V line in FIG. 1.

FIGS. 1 and 2 illustrate a first embodiment according to the present invention. FIG. 1 is a schematic front view illustrating the cell structure of a surface-discharge-type alternating-current PDP in the first embodiment. FIG. 2 is a sectional view taken along the V-V line in FIG. 1.

In FIGS. 1 and 2 the PDP has a plurality of row electrode pairs (X, Y) provided on the back-facing face (facing the rear of the PDP) of a front glass substrate 1 which serves as the display surface. The row electrode pairs (X, Y) each extend in the row direction of the front glass substrate 1 (the right-left direction in FIG. 1) and are regularly arranged in the column direction (the vertical direction in FIG. 1).

A row electrode X is composed of a bus electrode Xa formed of a metal film extending in the row direction of the front glass substrate 1, and T-shaped transparent electrodes Xb formed of a transparent conductive film made of ITO or the like. The transparent electrodes Xb are arranged evenly spaced apart from each other and connected to the bus electrode Xa so as to extend out from the bus electrode Xa in the column direction.

Likewise, a row electrode Y is composed of a bus electrode Ya formed of a metal film extending in the row direction of the front glass substrate 1, and T-shaped transparent electrodes Yb formed of a transparent conductive film made of ITO or the like. The transparent electrodes Yb are arranged evenly spaced apart from each other and connected to the bus electrode Ya so as to extend out from the bus electrode Ya in the column direction.

The row electrodes X and Y are arranged in alternate positions in the column direction of the front glass substrate 1 (the vertical direction in FIG. 1 and the right-left direction in FIG. 2). Each of the transparent electrodes Xb and Yb, which are regularly spaced along the associated bus electrodes Xa and Ya facing each other, extends out toward its counterpart in the row electrode pair, so that the wide distal ends of the transparent electrodes Xb and Yb face each other across a discharge gap g having a required width.

Each of the bus electrodes Xa, Ya of the row electrodes X, Y has a double layer structure made up of a black-colored conductive layer located close to the front glass substrate 1 and a white-colored conductive layer located on the opposite side of the black-colored conductive layer from the front glass substrate 1.

In addition, a dielectric layer 2 is deposited on the back-facing face of the front glass substrate 1 so as to overlie the row electrode pairs (X, Y).

In turn, a protective layer 3 is deposited on the dielectric layer 2 so as to overlie the back-facing face of the dielectric layer 2.

The structure of the protective layer 3 will be described later.

The front glass substrate 1 is placed parallel to a back glass substrate 4 across the discharge space. A plurality of column electrodes D are arranged parallel to each other at predetermined intervals on the face of the back glass substrate 4 facing the front glass substrate 1. Each of the column electrodes D extends in a direction at right angles to the bus electrodes Xa, Ya (i.e. in the column direction) on a portion of the back glass substrate 4 opposite to the paired transparent electrodes Xb and Yb of each row electrode pair (X, Y).

In addition, a column-electrode protective layer (dielectric layer) 5 is deposited on the face of the back glass substrate 4 facing the front glass substrate 1 so as to overlie the column electrodes D, and in turn a partition wall unit 6 having a shape as described below is formed on the column-electrode protective layer 5.

The partition wall unit 6 is formed in an approximate grid shape made up of transverse walls 6A and vertical walls 6B. Each of the transverse walls 6A extends in the row direction on a portion of the column-electrode protective layer 5 facing the area between the back-to-back bus electrodes Xa and Ya of the adjacent row electrode pairs (X, Y) when viewed from the front glass substrate 1. Each of the vertical walls 6B extends in the column direction on a portion of the column-electrode protective layer 5 facing an area between the adjacent transparent electrodes Xb and also between the adjacent transparent electrodes Yb which are arranged at regular intervals along the corresponding bus electrodes Xa, Ya of the row electrodes X, Y.

The partition wall unit 6 partitions the discharge space defined between the front glass substrate 1 and the back glass substrate 4 into areas each facing the opposing and paired transparent electrodes Xb, Yb to form discharge cells C.

A phosphor layer 7 is formed on the five faces facing the discharge space in each discharge cell C: the four side faces of the transverse walls 6A and the vertical walls 6B of the partition wall unit 6 and the face of the column-electrode protective layer 5. The colors of the phosphor layers 7 in the respective discharge cells C are arranged such that red, green and blue colors are arranged in order in the row direction one to each discharge cell C.

The discharge cells C are filled with discharge gas including xenon.

Figure 3:
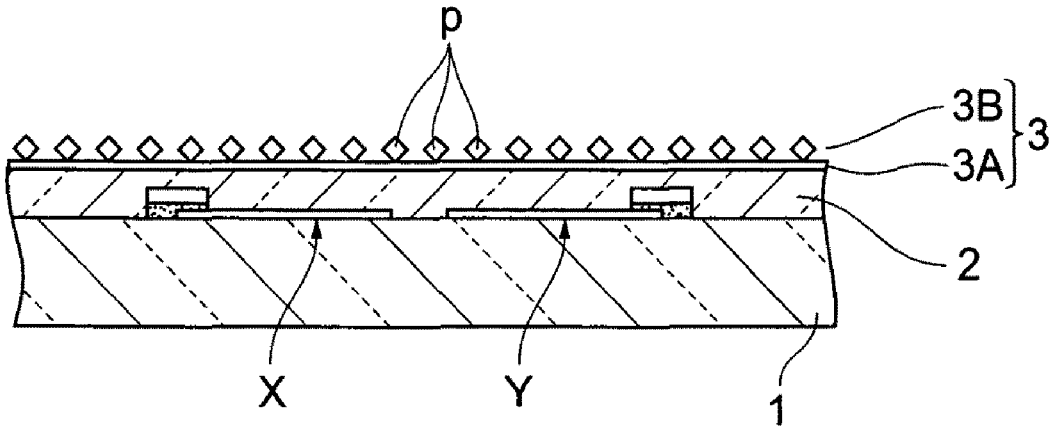
FIG. 3 is a sectional view illustrating the structure of a protective layer in the first embodiment.

As illustrated in FIG. 3, the protective layer 3 has a double layer structure made up of a thin-film magnesium oxide layer 3A and a crystalline magnesium oxide layer 3B. The thin-film magnesium oxide layer 3A is formed by vapor deposition or sputtering on the back-facing face of the dielectric layer 2. The crystalline magnesium oxide layer 3B is deposited by spraying, on the back-facing face of the thin-film magnesium oxide layer 3A, magnesium oxide single-crystal particles p in which aluminum (Al) atoms are doped into the single crystal and which have characteristics as described below.

Figure 4:
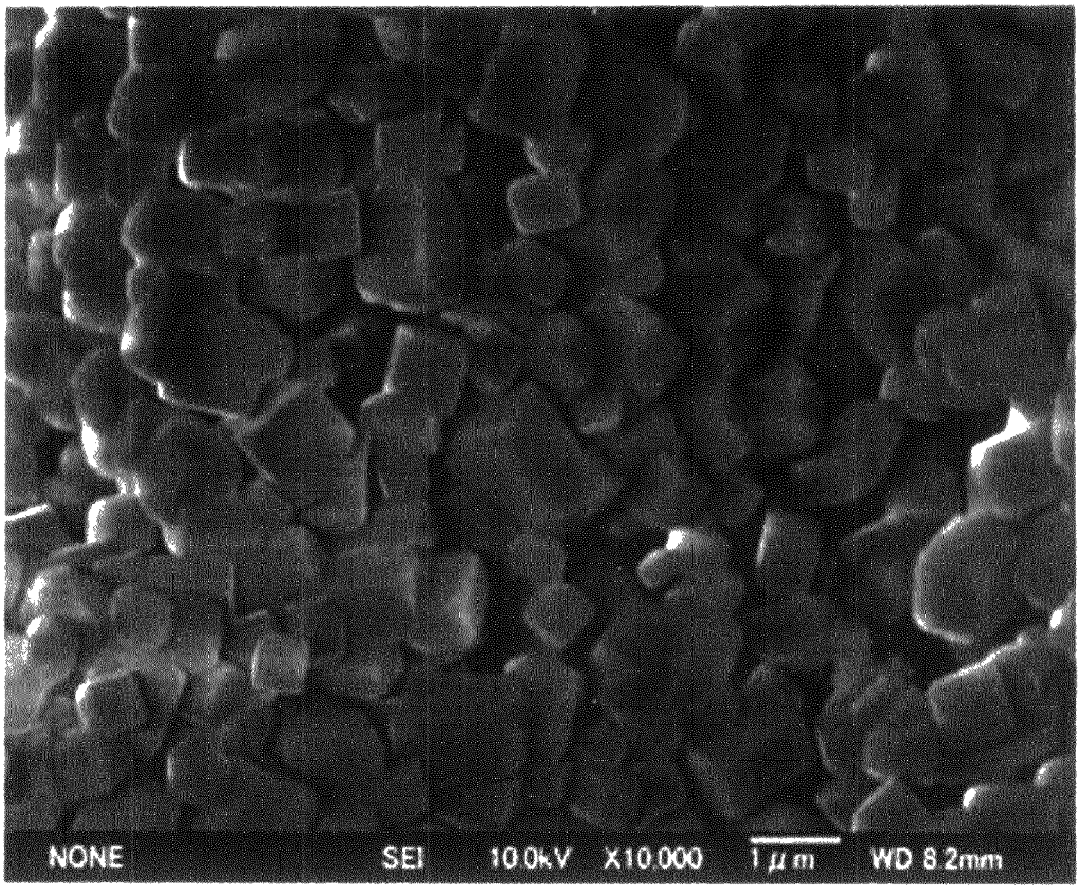
FIG. 4 is a SEM photograph of the magnesium oxide single-crystal particles in the first embodiment.

FIG. 4 shows a SEM photograph of the magnesium oxide single crystal having the cubic or rectangular parallelepiped single-crystal structure. The magnesium oxide single crystal has characteristics of causing cathode luminescence (CL) emitting ultraviolet light having a peak within a wavelength range of 200 nm to 300 nm (more specifically, of 230 nm to 250 nm, around 235 nm) upon excitation by electron beams, and photoluminescence (PL) emitting ultraviolet light having a peak within a wavelength range of 200 nm to 300 nm (more specifically, of 230 nm to 250 nm, around 235 nm) upon excitation by ultraviolet light at 147-nm wavelength, for example.

The magnesium oxide single-crystal particles p are produced from magnesium chloride used as raw material by a liquid phase method. In this producing process, aluminum chloride is added and reacts with the magnesium oxide, with the result that the aluminum atoms are doped into the single crystal of the magnesium oxide.

The magnesium oxide single-crystal particles p are dispersed in a solvent and then sprayed onto the thin-film magnesium oxide layer 3A to form the crystalline magnesium oxide layer 3B.

The magnesium oxide single-crystal particles p used to form the crystalline magnesium oxide layer 3B preferably have an average particle diameter between 10 nm and 10 μm when measured by the BET method.

The aluminum concentration in the magnesium oxide single-crystal particles p is preferably determined between 10 ppm and 10,000 ppm as described later.

In the operation for generating an image, the PDP first initiates a reset discharge between the row electrodes X and Y in the discharge cells C, and then an address discharge selectively between the row electrode Y and the column electrode D.

The address discharge results in the distribution of the discharge cells C (light-emitting cells) having the deposition of the wall charge on the surface of the protective layer 3, and the discharge cells C (no-light-emitting cells) without deposition of the wall charge over the panel surface in accordance with the image to be generated.

Subsequently to the address discharge, a sustaining discharge is produced between the paired transparent electrodes Xb and Yb of the row electrode pair in each of the light-emitting cells. The sustaining discharge results in the emission of visible light from the red, green and blue phosphor layers 7 in the light-emitting cells to generate a matrix-display image on the panel surface.

The crystalline magnesium oxide layer 3B including the magnesium single-crystal particles p forms the face of the protective layer 3 facing the discharge cells C. As a result, the foregoing PDP can be significantly improved in discharge delay in the discharge operation. This will be described below.

Figure 5:
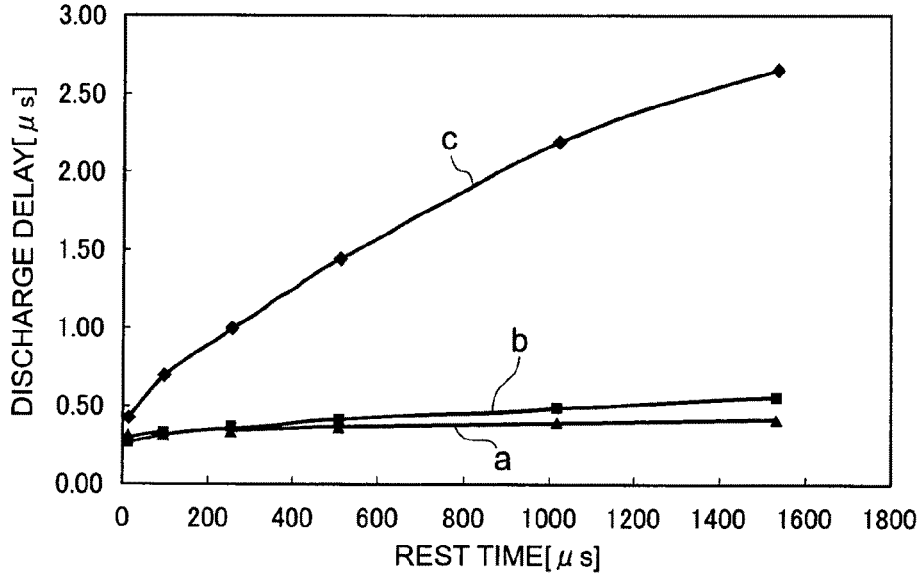
FIG. 5 is a graph showing the comparison between discharge delay characteristics.

FIG. 5 is a graph with the vertical axis representing discharge delay time and the horizontal axis representing discharge rest time. The graph shows a comparison among the discharge delay in three PDPs: (Graph a) the PDP in which the crystalline magnesium layer 3B of the protective layer 3 includes magnesium oxide single-crystal particles p doped with 1100 ppm aluminum; (Graph b) the PDP in which a crystalline magnesium layer of a protective layer includes magnesium oxide single-crystal particles p doped with 14 ppm aluminum; and (Graph c) the PDP in which a protective layer includes only a thin-film magnesium oxide layer formed by vapor deposition.

As seen from FIG. 5, whatever the period of the rest time, the discharge delay time is significantly shorter in the PDP that has the protective layer 3 including the crystalline magnesium oxide layer 3B formed of the magnesium oxide single-crystal particles p doped with aluminum than that in the PDP that has the protective layer including the thin-film magnesium oxide layer alone.

A description will be given of the estimated reason that, in this manner, the discharge delay in the PDP having the crystalline magnesium oxide layer 3B formed in a portion of the protective layer 3 facing the discharge cells C is shorter than that in the PDP having the protective layer including the thin-film magnesium oxide layer alone. Because aluminum is doped in high-purity magnesium oxide single-crystal prepared by the liquid phase method, the luminescent center of CL (of PL) between 200 nm and 300 nm is formed in a band gap of the magnesium oxide, whereby the magnesium oxide single-crystal has an energy level corresponding to the peak wavelength of the CL (or PL), As a result, the energy level enables the trapping of electrons for a long time (some msec. or more), and the trapped electrons are extracted by an electric field so as to serve as the primary electrons required for starting a discharge.

Accordingly, the greater the discharge delay in the PDP is improved, the higher the energy level of the magnesium oxide single-crystal and the longer the peak wavelength of CL (or PL).

Figure 6:
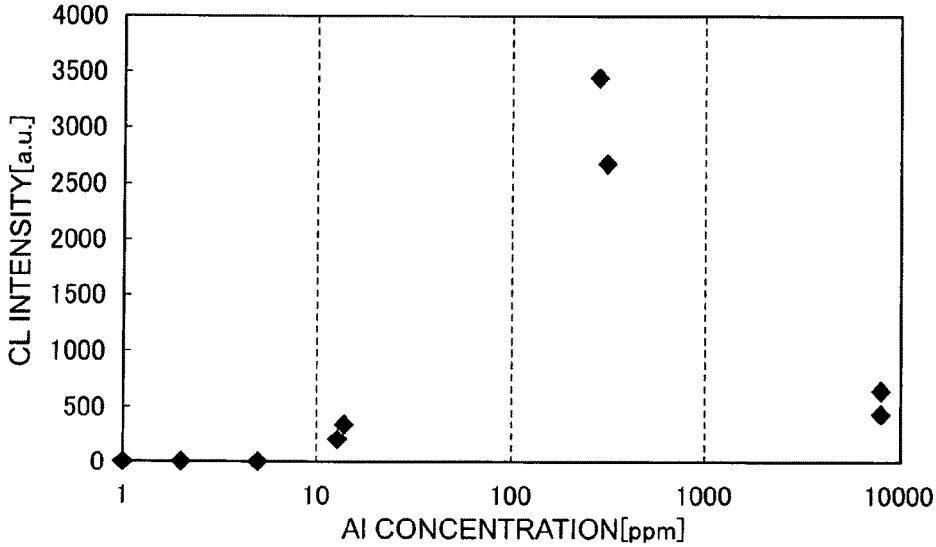
FIG. 6 is a graph showing a comparison between CL intensities with reference to Al concentrations in the magnesium oxide crystal.

FIG. 6 is a graph showing the relationship between the CL intensity and the aluminum concentration in the magnesium oxide single-crystal particles p, in which the vertical axis represents CL intensity and the horizontal axis represents CL wavelength.

It is seen from the graph in FIG. 6 that the CL intensity sharply increases when the aluminum concentration in a range from 10 ppm to 10,000 ppm.

Figure 7:
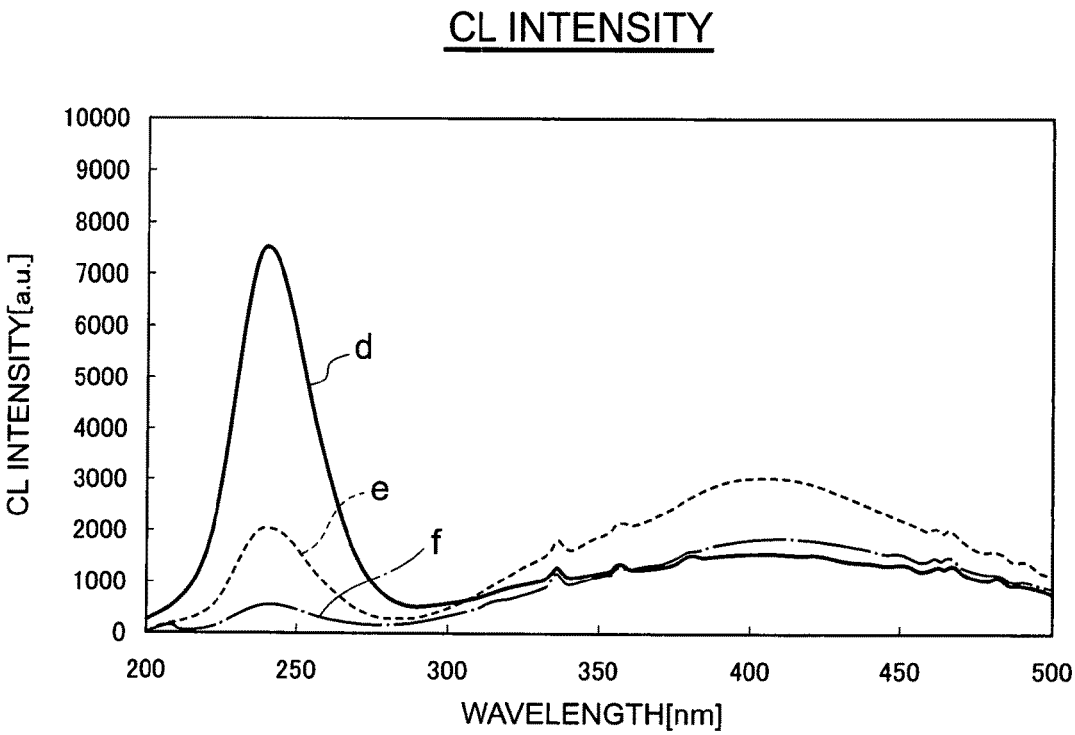
FIG. 7 is a graph showing a comparison between peak CL intensities of the magnesium oxide single crystals produced by a liquid phase method and a gas phase method.

FIG. 7 is a graph with the vertical axis representing CL intensity and the horizontal axis representing CL wavelength. The graph shows a comparison among the CL intensities in peak wavelength range: of (Graph d) of the magnesium oxide single-crystal particles p doped with 1100 ppm aluminum; of (Graph e) the magnesium oxide single-crystal particles p doped with 14 ppm aluminum; and of (Graph f) the magnesium oxide single-crystal particles produced by a gas phase method.

As seen from FIG. 7, in the peak wavelength range from 230 nm to 250 nm (more specifically, around 235 nm), the magnesium oxide single-crystal particles p prepared by the liquid phase method and doped with aluminum cause higher intensity CL (accordingly, effectively provide a greater improvement in the discharge delay) than that of the magnesium oxide single-crystal particles produced by a gas phase method. Also, it is seen from FIG. 7 that the magnesium oxide single-crystal particles p prepared by the liquid phase method and doped with 1100 ppm aluminum cause higher intensity CL in the peak wavelength range than that of the magnesium oxide single-crystal particles produced by the liquid phase method and doped with 14 ppm aluminum (accordingly, effectively provide a greater improvement in the discharge delay).

As described above, the PDP is designed such that the crystalline magnesium oxide layer 3B including the magnesium oxide single-crystal particles p which are prepared by a liquid phase method and of which aluminum is doped into the single crystal of magnesium oxide is disposed in a portion of the protective layer 3 facing the discharge cells C. In this PDP the magnesium oxide single-crystal particles p have characteristics of causing CL (or PL) having a peak in a wavelength range of 200 nm to 300 nm (more specifically, of 230 nm to 250 nm, around 235 nm). Also, the CL intensity (or PL intensity) in the peak wavelength range caused by the magnesium oxide single-crystal particles p is higher than the CL intensity (or PL intensity) in the peak wavelength range caused by the magnesium oxide crystal particles which are prepared by a gas phase method, thus making it possible to provide a greater improvement in the discharge delay in a PDP than the case of a conventional PDP having a crystalline magnesium oxide layer formed of magnesium oxide crystal particles produced by a gas phase method. In consequence, a PDP with enhanced performance capabilities required for forming a high definition screen such as a full HD screen can be offered.

Second Embodiment

Figure 8:
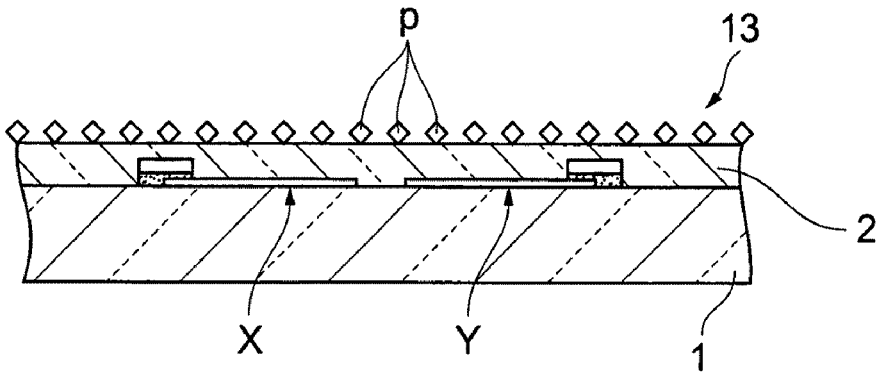
FIG. 8 is a sectional view illustrating a second embodiment of the present invention.

FIG. 8 is a sectional view illustrating a second embodiment of the PDP according to the present invention, which is taken along the same line as that of FIG. 3 in the first embodiment.

The same components as those in the PDP of the first embodiment are designated by the same reference numerals in FIG. 8 as those in FIG. 3.

The protective layer of the PDP in the first embodiment has a double layer structure of the crystalline magnesium oxide layer laminated on the thin-film magnesium oxide layer, but a protective layer 13 of the PDP in the second embodiment, which overlies the back-facing face of the dielectric layer 2, comprises only a crystalline magnesium oxide layer that is formed by spraying magnesium oxide single-crystal particles p on the back-facing face of the dielectric layer 2. The magnesium oxide single-crystal particles p are produced by a liquid phase method, so that aluminum (Al) atoms are doped into the single crystal. The magnesium oxide single-crystal particles p have characteristics of causing CL (or PL) having a peak within a wavelength range of 200 nm to 300 nm (more specifically, of 230 nm to 250 nm, around 235 nm).

The magnesium oxide single-crystal particles p used to form the protective layer 13 preferably have an average particle diameter between 10 nm and 10 μm when measured by the BET method, and the aluminum concentration is preferably determined between 10 ppm and 10,000 ppm as described later, as in the case of the first embodiment.

As in the case of the first embodiment, the PDP of the second embodiment also comprises the protective layer 13 comprising the crystalline magnesium oxide layer that includes the magnesium oxide single-crystal particles p which is produced by a liquid phase method and in which aluminum is doped in the single crystal of the magnesium oxide. The magnesium oxide single-crystal particles p have characteristics of causing CL (or PL) having a peak in a wavelength range of 200 nm to 300 nm (more specifically, of 230 nm to 250 nm, around 235 nm). Also, the CL intensity (or PL intensity) in the peak wavelength range caused by the magnesium oxide single-crystal particles p is higher than the CL intensity (or PL intensity) in the peak wavelength range caused by the magnesium oxide crystal particles which are prepared by a gas phase method, thus making it possible to much more improve the discharge delay in a PDP than the case of a conventional PDP having a crystalline magnesium oxide layer comprising magnesium oxide crystal particles produced by a gas phase method. In consequence, a PDP with enhanced performance capabilities required for forming a high definition screen such as a full HD screen can be offered.

Third Embodiment

Figure 9:
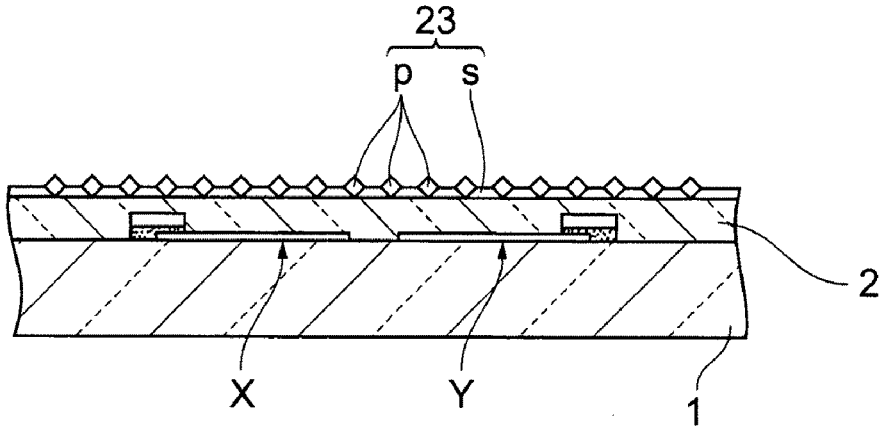
FIG. 9 is a sectional view illustrating a third embodiment of the present invention.

FIG. 9 is a sectional view illustrating a third embodiment of the PDP according to the present invention, which is taken along the same line as that of FIG. 3 of the first embodiment.

The same components as those in the PDP of the first embodiment are designated by the same reference numerals in FIG. 9 as those in FIG. 3.

The PDP in the third embodiment comprises a protective layer 23 comprising only a crystalline magnesium oxide layer that is formed of magnesium oxide single-crystal particles p which are produced by a liquid phase method so as to dope aluminum into the single crystal and which have characteristics of causing CL (or PL) having a peak within a wavelength range of 200 nm to 300 nm (more specifically, of 230 nm to 250 nm, around 235 nm). This is the same as the structure of the PDP in the second embodiment. In the second embodiment the crystalline magnesium oxide layer is formed by spraying the magnesium oxide single-crystal particles on the back-facing face of the dielectric layer. However, the crystalline magnesium oxide layer forming the protective layer 23 is formed by applying a paste s including the magnesium oxide single-crystal particles p on the back-facing face of dielectric layer 2, and then by being calcined while the magnesium oxide single-crystal particles p are exposed to the discharge space.

The structure of the magnesium oxide single-crystal particles p and the like, apart from the foregoing, are the same as those of the first embodiment. The PDP of the third embodiment having the magnesium oxide single-crystal particles p exposed to the discharge space can realize the same technical operational advantages as those of the PDP in the first embodiment.

Fourth Embodiment

Figure 10:
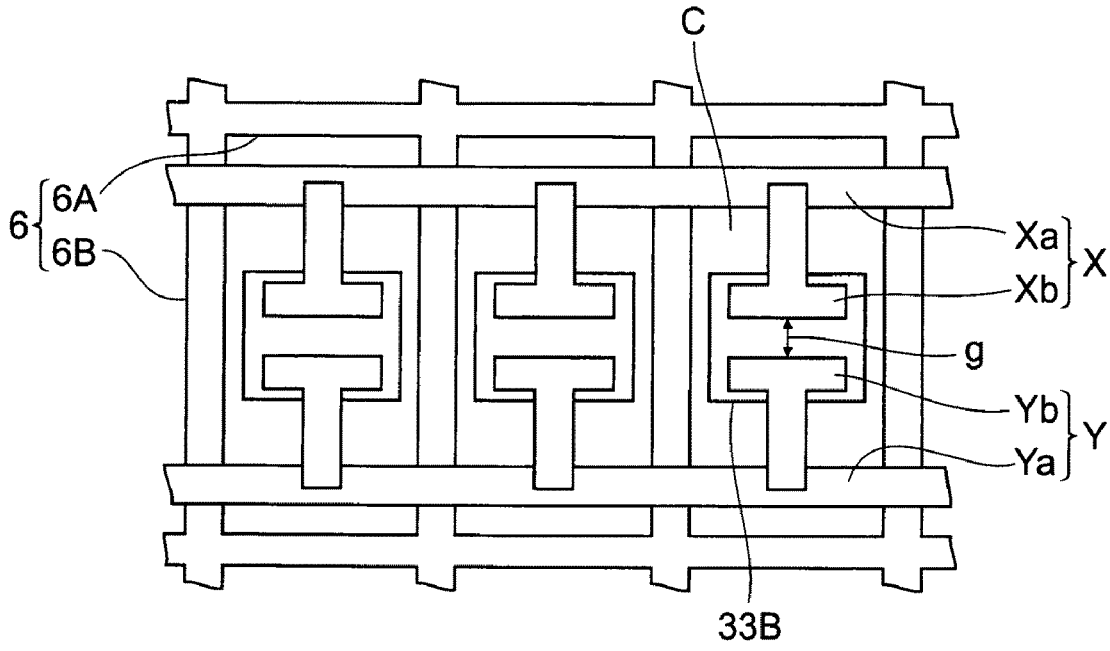
FIG. 10 is a front view illustrating a fourth embodiment of the present invention.

FIG. 10 is a front view illustrating a fourth embodiment of the PDP according to the present invention.

The same components as those in the PDP of the first embodiment are designated by the same reference numerals in FIG. 10 as those in FIG. 1.

The first embodiment has described the PDP in which the crystalline magnesium oxide layer, which forms part of the protective layer and is formed of the magnesium oxide single-crystal particles, is deposited over the full back-facing face of the thin-film magnesium oxide layer. However, in the PDP of the fourth embodiment, by use of a patterning technique, a crystalline magnesium oxide layer 33B, which is formed of magnesium oxide single-crystal particles p produced by a liquid phase method so as to dope aluminum into the single crystal and having characteristics of causing CL (or PL) having a peak within a wavelength range of 200 nm to 300 nm (more specifically, of 230 nm to 250 nm, around 235 nm), is formed on a portion of the back-facing face of the thin-film magnesium oxide layer forming part of the protective layer, the portion facing a required area (a quadrangular area in FIG. 10) including the opposing leading ends of the respective transparent electrodes Xb, Yb of the row electrodes X, Y and the discharge gap g between the opposing leading ends in each discharge cell C.

The structure of the magnesium oxide single-crystal particles p and the like, apart from the foregoing, are the same as those of the first embodiment. The PDP of the fourth embodiment having the magnesium oxide single-crystal particles p forming the crystalline magnesium oxide layer 33B and exposed to the discharge space can realize the same technical operational advantages as those of the PDP in the first embodiment.

Fifth Embodiment

Figure 11:
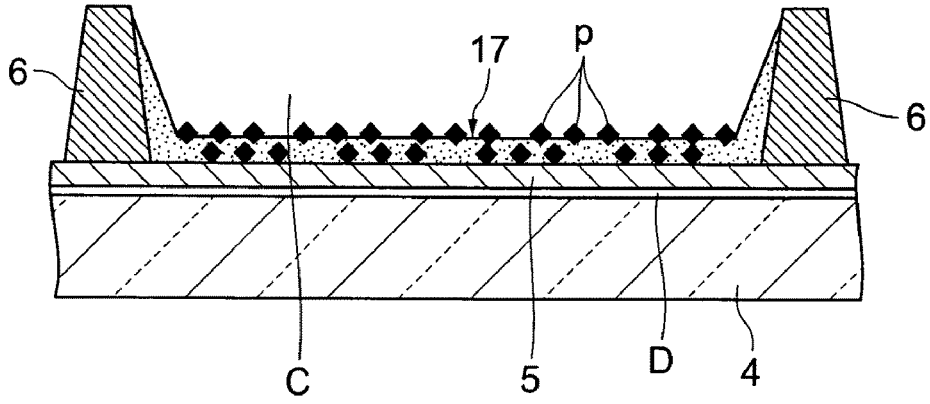
FIG. 11 is a sectional view illustrating a fifth embodiment of the present invention.

FIG. 11 is a sectional view illustrating a fifth embodiment of the PDP according to the present invention, which shows only the structure on the back-glass substrate of the PDP.

The same components as those in the PDP of the first embodiment are designated by the same reference numerals in FIG. 11 as those in FIG. 2.

The foregoing first to fourth embodiments have described the examples of the protective layer having the crystalline magnesium oxide layer. In the PDP of the fifth embodiment, the magnesium oxide single-crystal particles p, which are produced by a liquid phase method so as to dope aluminum into the single crystal and have characteristics of causing CL (or PL) having a peak within a wavelength range of 200 nm to 300 nm (more specifically, of 230 nm to 250 nm, around 235 nm), are mixed into the phosphor layer 17 deposited on the back glass substrate 4 with at least a part of the magnesium oxide single-crystal particles p being exposed to the discharge space.

The structure of the magnesium oxide single-crystal particles p and the like, apart from the foregoing, are the same as those of the first embodiment. The PDP of the fifth embodiment having the magnesium oxide single-crystal particles p exposed to the discharge space can realize the same technical operational advantages as those of the PDP in the first embodiment.

In the fifth embodiment, required technical operational advantages can be realized by mixing the magnesium oxide single-crystal particles p into only the phosphor layer 17, but a crystalline magnesium oxide layer including the magnesium oxide single-crystal particles p may be disposed in the protective layer as described in the first to fourth embodiments, thereby effectively providing greater improvement in discharge delay.

The PDP described in each of the aforementioned embodiments is based on a basic idea that a PDP comprises a pair of opposing substrates placed across a discharge space, discharge electrodes disposed between the opposing substrates, a dielectric layer covering the discharge electrodes, and phosphor layers, the discharge space being divided to form a plurality of unit light emission areas arranged in matrix form, in which magnesium oxide crystal particles doped with a required concentration of aluminum and having characteristics of causing cathode luminescence having a peak within a wavelength range of 200 nm to 300 nm upon excitation by application of electron beams are disposed in a position facing each unit light emission area between the pair of opposing substrates.

In the PDP based on this basic idea, the magnesium oxide crystal particles disposed in a position facing each unit light emission area have characteristics of causing cathode luminescence having a peak within a wavelength range of 200 nm to 300 nm upon excitation by electron beams, thereby improving the discharge delay in the discharge operation of the PDP. In addition, the magnesium oxide crystal particles are doped with a required concentration of aluminum, thereby further improving the discharge delay. In consequence, it is possible to implement an increase in performance of the PDP to generate a high definition screen such as a full HD screen.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, comprising:

a pair of opposing substrates placed across a discharge space, discharge electrodes disposed between the pair of opposing substrates, a dielectric layer covering the discharge electrodes, and phosphor layers, the discharge space being divided to form a plurality of unit light emission areas arranged in matrix form, wherein magnesium oxide crystal particles are single crystals formed by a liquid phase method and doped with a required concentration of aluminum, the magnesium oxide single crystals have characteristics of causing cathode luminescence having a peak within a wavelength range of 200 nm to 300 nm upon excitation by application of electron beams are disposed in a position facing each unit light emission area between the pair of opposing substrates, and the concentration of aluminum doped in the magnesium oxide single crystals is equal to or greater than 400 ppm.

2. A plasma display panel according to claim 1, wherein the concentration of aluminum doped in the magnesium oxide single crystals ranges from 400 ppm to 10,000 ppm.

3. A plasma display panel according to claim 1, wherein the magnesium oxide single crystals are exposed to the unit light emission areas.

4. A plasma display panel according to claim 3, further comprising a thin-film magnesium oxide layer formed on the dielectric layer by vapor deposition or sputtering, wherein the magnesium oxide single crystals are disposed on the thin-film magnesium oxide layer and the magnesium oxide single crystals together with the thin-film magnesium oxide layer form the protective layer for the dielectric layer.

* * * * *